US009259751B2

(12) United States Patent
Crawford et al.

(10) Patent No.: US 9,259,751 B2
(45) Date of Patent: Feb. 16, 2016

(54) DISPENSING CONTAINER WITH ENHANCED APPEARANCE

(75) Inventors: John C. Crawford, Mahopac, NY (US); Rensl Dillon, Ewing, NJ (US); Lester Greer, Sandpoint, ID (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 0 days.

(21) Appl. No.: 14/235,728

(22) PCT Filed: Aug. 1, 2011

(86) PCT No.: PCT/US2011/046135

§ 371 (c)(1),
(2), (4) Date: Jan. 28, 2014

(87) PCT Pub. No.: WO2013/019207

PCT Pub. Date: Feb. 7, 2013

(65) Prior Publication Data

US 2014/0175122 A1 Jun. 26, 2014

(51) Int. Cl.
*B05B 11/00* (2006.01)
*B05B 15/00* (2006.01)
(Continued)

(52) U.S. Cl.
CPC ..... *B05B 11/0089* (2013.01); *B05B 11/0037* (2013.01); *B05B 15/007* (2013.01);
(Continued)

(58) Field of Classification Search
CPC ..... A45D 2034/007; A45D 2200/052; A45D 2200/053; B05B 11/0005; B05B 11/0037; B05B 11/0089; B05B 11/02; B05B 11/30; B05B 11/3001; B05B 15/007; B65D 2203/00; A47G 21/182
USPC ..... 222/1, 113, 192, 321.7, 321.9, 382, 222/464.1, 464.6, 464.7, 78
See application file for complete search history.

(56) References Cited

U.S. PATENT DOCUMENTS 1,916,646 A 7/1933 Tycko
1,976,762 A 10/1934 Barker
(Continued)

FOREIGN PATENT DOCUMENTS

CN 2527184 12/2002
CN 2933197 8/2007
(Continued)

OTHER PUBLICATIONS

International Search Report and the Written Opinion issued in International Application PCT/US2011/046135 mailed Apr. 16, 2012.

*Primary Examiner* — Frederick C Nicolas
*Assistant Examiner* — Bob Zadeh

(57) ABSTRACT

A container comprising a body portion and a neck portion, the neck portion having a pump dispenser thereon, the pump dispenser comprising a pump mechanism, a dip tube on one end of the pump mechanism, a pump outlet on another end of the pump mechanism, the dip tube extending from the pump mechanism into the body portion, the body portion containing a liquid, and a motion element, the motion element being captive within the dip tube and adapted to be movable within the dip tube under the action of liquid flow through the dip tube, and at least a portion of the body portion being transparent, a decorative effect resulting from the motion of the motion element being visible from an exterior of the container. Also disclosed is a method of providing an enhanced display by a dispensing container during dispensing of a liquid from the container.

20 Claims, 9 Drawing Sheets

(51) Int. Cl.
*A45D 34/00* (2006.01)
*A47G 21/18* (2006.01)

(52) U.S. Cl.
CPC ..... *A45D2034/007* (2013.01); *A45D 2200/053* (2013.01); *A47G 21/182* (2013.01); *B65D 2203/00* (2013.01)

(56) References Cited

U.S. PATENT DOCUMENTS

| | | | | |
|---|---|---|---|---|
| 2,544,594 | A | 3/1951 | Goldfarb | |
| 2,590,279 | A | 3/1952 | Soss | |
| 3,332,622 | A | 7/1967 | Lombard | |
| 3,388,835 | A * | 6/1968 | Naughten | 222/78 |
| 4,054,026 | A * | 10/1977 | Goodrich | 368/93 |
| 4,252,273 | A | 2/1981 | Karterman | |
| 4,327,782 | A * | 5/1982 | McKibben et al. | 141/26 |
| 5,417,357 | A * | 5/1995 | Yquel | 222/402.24 |
| 5,426,877 | A | 6/1995 | Lin | |
| 6,006,958 | A | 12/1999 | Bitton | |
| 6,276,566 | B1 | 8/2001 | Zaksenberg | |
| 6,279,778 | B1 | 8/2001 | Ho et al. | |
| 6,345,731 | B2 | 2/2002 | Bitton | |
| 6,592,007 | B2 | 7/2003 | Ho et al. | |
| 6,729,500 | B1 * | 5/2004 | Dobbs et al. | 222/78 |
| 6,918,510 | B2 | 7/2005 | Bitton | |
| 7,954,669 | B2 | 6/2011 | VanGordon et al. | |
| 7,971,755 | B2 | 7/2011 | Faurie | |
| 2007/0010158 | A1 * | 1/2007 | Bitton | 446/16 |

FOREIGN PATENT DOCUMENTS

| | | |
|---|---|---|
| JP | S51128680 | 10/1976 |
| JP | S53-18290 | 2/1978 |
| JP | S63-161581 | 10/1988 |
| JP | 3082555 U | 12/2001 |
| JP | 3116363 | 12/2005 |
| KR | 20-0319605 | 7/2003 |

* cited by examiner

DISPENSING CONTAINER WITH ENHANCED APPEARANCE

CROSS-REFERENCE TO RELATED PATENT APPLICATIONS

The present application is a U.S. national stage application under 35 U.S.C. 371 of PCT Application No. PCT/US2011/046135, filed Aug. 1, 2011, the entirety of which is incorporated herein by reference.

FIELD OF THE INVENTION

This invention is directed to a dispensing container that has an enhanced appearance. More particularly, this invention is directed to a dispensing container where the dip tube is provided with a dynamic decorative feature which is revealed on use of the dispensing container to dispense a product. The decorative feature may optionally coordinate with a design on the front or rear of the container.

BACKGROUND OF THE INVENTION

Dispensing containers with dip tubes are used to store and dispense a range of personal care products. These include hand soaps, hand and body lotions, shampoos and body cleansing gels. There is a constant need to enhance the appearance of these containers. Various prior patent specifications disclose structures intended to enhance the appearance of the container, and some exhibit a dynamic, moving feature which is operable during dispensing. Examples of such US Patents are: U.S. Pat. Nos. 6,729,500, 6,345,731, 6,279,778, 6,592,007, 6,006,958, 1,916,646, 2,590,279, 1,976,762, 5,426,877, 5,937,554, 6,073,373 and 6,233,856. However, such constructions have a limited visual effect and/or are complicated in construction. U.S. Pat. Nos. 7,954,669, 6,276,566, and 6,918,510 disclose the provision of static decoration associated with the dip tube within a dispensing container.

The present invention aims to improve the dynamic enhancement of the appearance of a container and its product during use.

The present invention also aims to provide a simple and reliable structure which can be dynamically operated by the user during product dispensing.

The present invention further aims to provide a dispensing structure which functionally indicates product dispensing as well as enhancing the appearance of the container and its product during product dispensing.

BRIEF SUMMARY OF THE INVENTION

The invention provides a container comprising a body portion and a neck portion, the neck portion having a pump dispenser thereon, the pump dispenser comprising a pump mechanism, a dip tube on one end of the pump mechanism, a pump outlet on another end of the pump mechanism, the dip tube extending from the pump mechanism into the body portion, the body portion containing a liquid, and a motion element, the motion element being located within the dip tube and adapted to be movable within the dip tube under the action of liquid flow through the dip tube, and at least a portion of the body portion being transparent, a decorative effect resulting from the motion of the motion element being visible from an exterior of the container.

Optionally, at least a portion of the dip tube is transparent and the motion element is visible from an exterior of the container. Further optionally, the motion element comprises a decoration.

The container may further comprise a decorative part located outside the dip tube and connected to the motion element.

In some embodiments, the motion element is mounted for rotational motion, optionally about a fixed axis. The fixed axis is optionally perpendicular to a longitudinal axis of the dip tube. The dip tube may include an enlarged chamber, which may be cylindrical, within which the motion element is disposed. In one particular embodiment, the motion element comprises a wheel. The wheel optionally has a plurality of radial vanes. The wheel may comprise a decoration or may carry a decorative element which is located outside the dip tube. The decorative element may be a disc having at least one image, typically a plurality of circumferentially arranged images.

In some embodiments, the motion element and the dip tube are dimensioned to permit translational motion of the motion element along a portion of the dip tube. The container may further comprise a decorative element located outside the dip tube and connected to the motion element, translation of the motion element causing translation of the decorative element. The decorative element may optionally comprise a shape representative of a living creature. Typically, the dip tube includes lower and upper restrictions defining lower and upper extremities of the portion of the dip tube along which the motion element can move translationally.

In some particular embodiments, as well as translational motion of the motion element, the motion element and the dip tube are dimensioned additionally to permit rotational motion of the motion element within the dip tube. In some embodiments, the motion element may be a sphere. Optionally, the sphere is externally patterned to resemble a sports ball. In some embodiments, the motion element may be a spiral or a fan element.

In some embodiments, the motion element comprises a plurality of particles mounted for random motion within the dip tube. Optionally, at least some of the plurality of particles have at least one identifiable shape. The dip tube typically includes an upper mesh screen defining therebelow a chamber within which the plurality of particles are located.

In some embodiments, the motion element and the dip tube are adapted to cause the motion element to move within the dip tube on pumping of the pump mechanism by a single pump stroke to cause liquid in the container to flow through the dip tube towards the pump mechanism. In some embodiment, the movement of the motion element within the dip tube may be used as a timer.

Optionally, the motion element and the dip tube are adapted to permit the motion element to move a defined extent on pumping of the pump mechanism by a single pump stroke. Typically, the defined extent indicates the dispensing of a defined amount of the liquid.

The invention further provides a method of providing an enhanced display by a dispensing container during dispensing of a liquid from the container, the method comprising the steps of:

a. providing a dispensing container including a pump mechanism and a dip tube extending from the pump mechanism into liquid to be dispensed from the container;

b. operating the pump mechanism to cause liquid to flow through the dip tube and out of an end of the pump mechanism; and c. the liquid flow causing motion of a motion element located within the dip tube, the movement of the motion element causing a decorative effect which is visible from an exterior of the container.

In some embodiments, the motion element is visible within the dip tube and the decorative effect is the visible movement of the motion element. In some other embodiments, a decorative part is connected to the motion element and located outside the dip tube and the decorative effect is the visible movement of the decorative part.

In some embodiments, the liquid flow causes rotational motion of the motion element.

The rotational motion may be about a fixed axis and the at least one motion element may comprise a wheel. The wheel may be rotated in an enlarged chamber mounted to the dip tube.

In some embodiments, the liquid flow causes translational motion of the motion element along a portion of the dip tube. Typically, the translational motion is constrained between lower and upper extremities of the portion of the dip tube.

In some embodiments, the motion element comprises a plurality of particles and the liquid flow causes random motion of the plurality of particles within the dip tube.

Optionally, the motion element moves within the dip tube on pumping of the pump mechanism by a single pump stroke to cause liquid in the container to flow through the dip tube towards the pump mechanism. The motion element may move a defined extent on pumping of the pump mechanism by a single pump stroke. The defined extent may indicate the dispensing of a defined amount of the liquid. The defined extent may also be used to determine a period of time associated with the movement of the motion element.

The invention also provides a liquid-dispensing container including a pump mechanism and a dip tube extending from the pump mechanism into a body portion of the container containing liquid to be dispensed from the container, a rotatable wheel mounted for rotational motion within the dip tube and adapted to be rotatable within the dip tube under the action of liquid flow through the dip tube.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

The following description of the preferred embodiment(s) is merely exemplary in nature and is in no way intended to limit the invention, its application, or uses. The dispensing container has an enhanced dynamic appearance when used by a consumer to dispense the product contained within the container.

Figure 1:
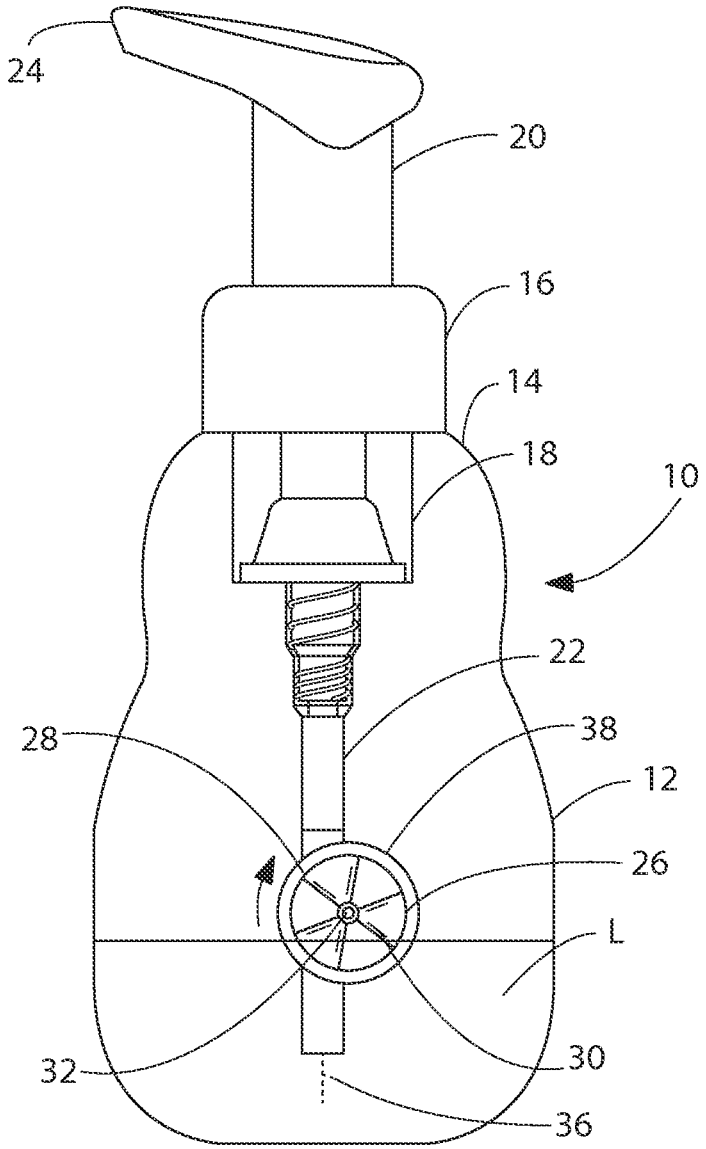
FIG. 1 is an elevation view of a dispensing container having a dip tube with a rotatable wheel in accordance with a first embodiment of the invention.

FIG. 1 shows a dispensing container 10 with the enhanced appearance. The dispensing container 10 is comprised of a body portion 12 and a neck portion 14. The neck portion 14 has a closure 16. Mounted in the closure 16 is a pump mechanism 18 with a dip tube 22 at one end and an actuator 20 with a dispensing channel exiting at a pump outlet 24. The dip tube 22 extends downwardly from the pump mechanism 18 into the body portion 12 which contains a liquid L to be dispensed. The liquid may be, for example, selected from hand soaps, hand and body lotions, shampoos and body cleansing gels. When the pump mechanism 18 is activated by manual depression of the dispensing activator 20, liquid in body portion 12 travels up dip tube 22, through the pump mechanism 18 and then through outlet 24. The pump mechanism 18 is a conventional self priming pump mechanism well known in the art.

A motion element 26 is captive within the dip tube 22. The motion element 26 is adapted to be movable within the dip tube 22 under the action of liquid flow through the dip tube 22 during the dispensing operation. In some embodiments, any liquid remaining in the dip tube 22 may flow back into the container 10 due to gravity. In such embodiments, the motion element 26 may also be movable within the dip tube under the action of liquid flow through the dip tube 22 into the container 10. At least a part of the body portion 12 is transparent. Accordingly, a decorative effect resulting from the motion of the motion element 26 is visible from an exterior of the container 10. In the embodiment of FIG. 1, at least a portion of the dip tube 22 is transparent and the motion element 26 is visible from an exterior of the container 10.

The motion element 26 comprises a wheel 28 having a plurality of radial vanes 30. The wheel 28 is mounted for rotational motion about a fixed axis which is perpendicular to a longitudinal axis of the dip tube 22. The dip tube 22 includes an enlarged cylindrical chamber 38 within which the wheel 28 is disposed.

The chamber 38 of the dip tube 22 may be a molded section, such as being formed by injection or blow molding, which is bonded to the dip tube 22. The dip tube 22 may be formed by extrusion to an elongated form.

In use, when liquid is pumped up the dip tube 22, the liquid flow applies hydraulic pressure to the vanes 30 which causes rotation of the wheel 28 during the dispensing operation. In this embodiment, the wheel 28 is decorative and is visible during the dispensing operation.

Figure 2:
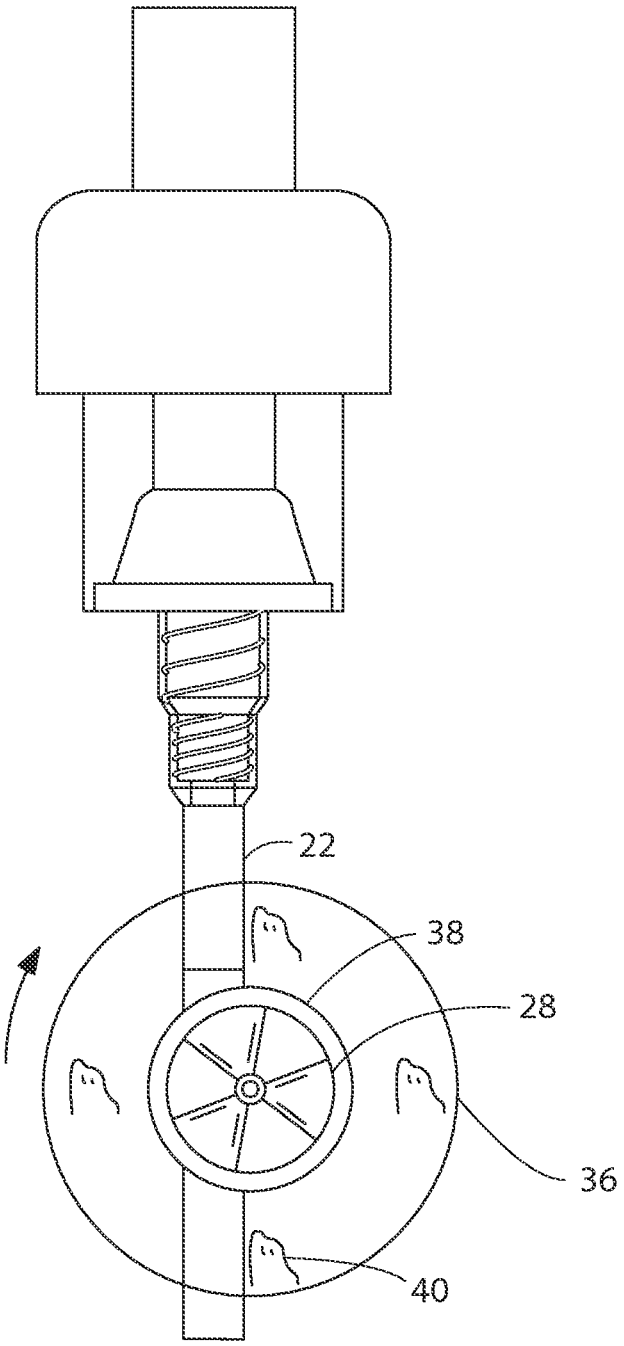
FIG. 2 is an elevation view of a dispensing mechanism having a dip tube with a rotatable wheel and a decorative element mounted thereto in accordance with a second embodiment of the invention.

In an alternative embodiment as shown in FIG. 2, the wheel 28 carries a decorative element 36 which is located outside the dip tube 22 and chamber 38. The decorative element 36 is connected to the wheel 28 captive within the dip tube 22.

Typically, as shown, the decorative element 36 is a disc having at least one image 40, more typically a plurality of circumferentially arranged images 40. The wheel 28 may be visible within the dip tube 22, by the dip tube 22 being transparent and the body portion 12 also being transparent in the adjacent region so that the wheel 28 can be seen by a user. Alternatively, the wheel 28 may not be visible within the dip tube 22, by the dip tube 22 being opaque and/or the body portion 12 only being transparent in the region adjacent to the decorative element 36 so that only the decorative element 36, or a portion thereof, can be seen by a user. In either case, whether or not the wheel 28 itself can be seen by a user during the dispensing operation, the wheel 28 is movable within the dip tube 22 under the action of liquid flow through the dip tube 22, and a decorative effect resulting from the motion of the wheel 28 is visible from an exterior of the container 10 by the provision of at least one transparent part of the body portion 12.

When the images are viewed through a transparent window of the body portion 12, for example a window in an opaque label revealing only a segment of the decorative element 36, the images 40 successively move across the window to provide an enhanced dynamic visual effect.

The wheel 28 is rotated by liquid flow through the dip tube 22. Therefore even if, as shown in FIG. 1, the liquid level is below the wheel 28, the liquid flow through the dip tube 22 ensures rotation of the wheel 28 in the chamber 38 throughout the dispensing life of the liquid in the container 10.

Figure 3:
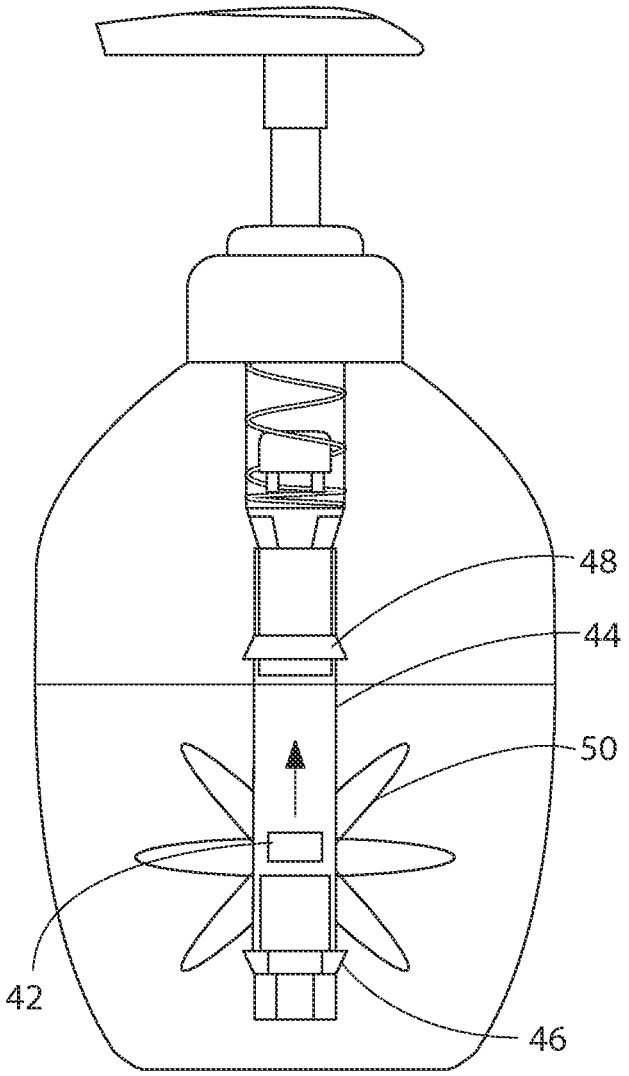
FIG. 3 is an elevation view of a dispensing container having a dip tube with a slider and a decorative element mounted thereto in accordance with a third embodiment of the invention.

In a further embodiment as shown in FIG. 3, the motion element 26 and the dip tube 22 are dimensioned to permit translational motion of the motion element 26 along a portion of the dip tube 22.

Figure 4:
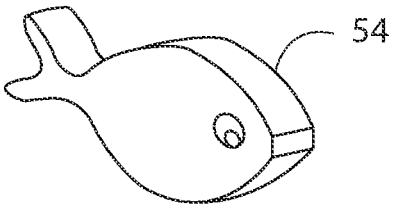
FIGS. 4 to 6 are perspective view of respective alternative decorative elements for use in the embodiment of FIG. 3.
Figure 5:
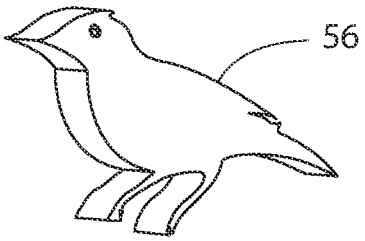
Figure 6:
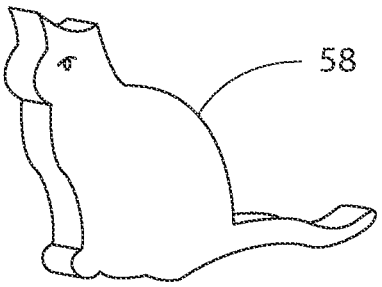

In this embodiment, the motion element 26 comprises a slider 42 within the dip tube 44. The dip tube 44 includes lower and upper restrictions 46, 48 defining lower and upper extremities of the portion of the dip tube 44 along which the slider 42 can move translationally. A decorative element 50 is located outside the dip tube 44 and is connected to the slider 42. For clarity of illustration the rear of the container and the rear of the decorative element 50 is shown in FIG. 3. However, the decorative element may entirely surround the dip tube 44. The decorative element 50 may have any desired shape and configuration, and in particular may comprise a shape representative of a flower 52 as shown in FIG. 3 or of a living creature, such as a fish 54, bird 56, or cat 58 as shown in FIGS. 4 to 6. Similarly, while the slider 42 is depicted as a generally cubical element, the slider 42 may assume other shapes, such as spherical, rectangular, etc.

Translation of the slider 42 as a result of fluid flow through the dip tube 44 dung the dispensing operation causes upward translation of the slider 42 and the decorative element 50 connected thereto. The decorative element 50, and its motion, can be viewed by the user, optionally through a window on the container 10. The motion of the slider 42 may or may not be visible, as described above for the first embodiment. After a dispensing cycle, the slider 42 slides back down the dip tube 44 due to gravity. As the slider 42 slides back down the dip tube 44, the decorative element 50 connected thereto also moves with translation of the slider 42.

Figure 10:
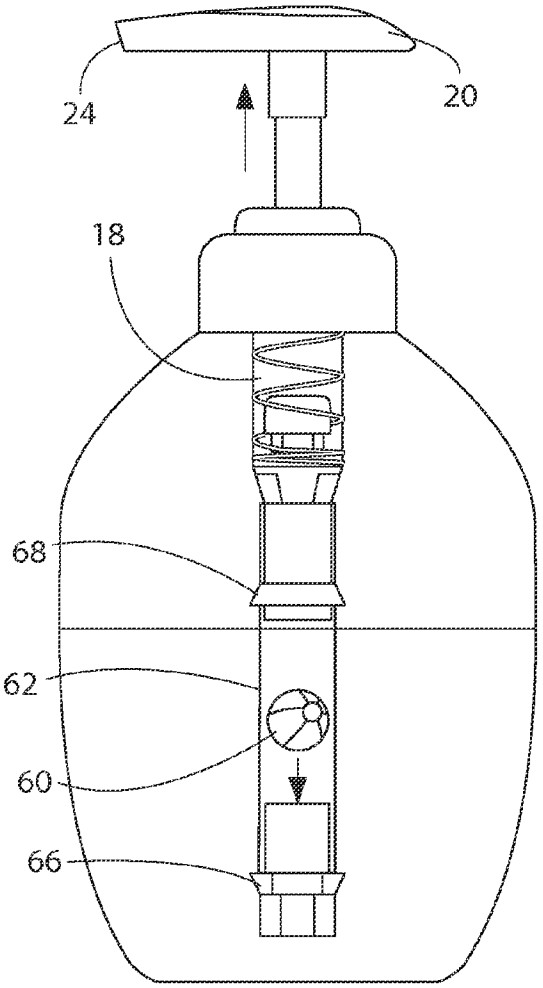
Figure 11:
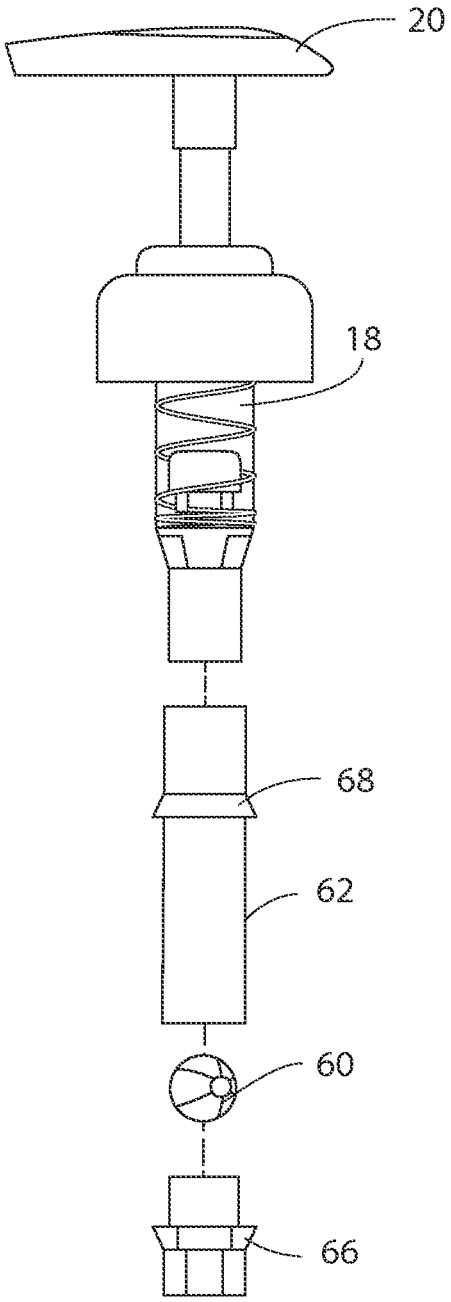
FIG. 11 is an elevation exploded view of the dispensing mechanism of the embodiment of FIGS. 7 to 10.

Referring to FIGS. 7 to 11, in a further embodiment the motion element 60 moves translationally within the dip tube 62 and furthermore the motion element 60 and the dip tube 62 are dimensioned additionally to permit rotational motion of the motion element 60 within the dip tube 62. In this embodiment, the motion element 60 is a sphere which is externally patterned to resemble a sports ball. In some embodiments, the motion element 60 may be a spiral or a fan element. In the embodiment as shown, the dip tube 62 includes lower and upper restrictions 66, 68 defining lower and upper extremities of the portion of the dip tube 62 along which the sphere 60 can move translationally. As shown in FIG. 11, the dip tube 62 can be press-fitted onto the lower end of the pump mechanism 18 and incorporate an integral upper restriction 68. The lower restriction 66 can be press-fitted onto the lower end of the dip tube 62. This captures the sphere 60 between the lower and upper restrictions 66, 68 within the dip tube 62.

Figure 8:
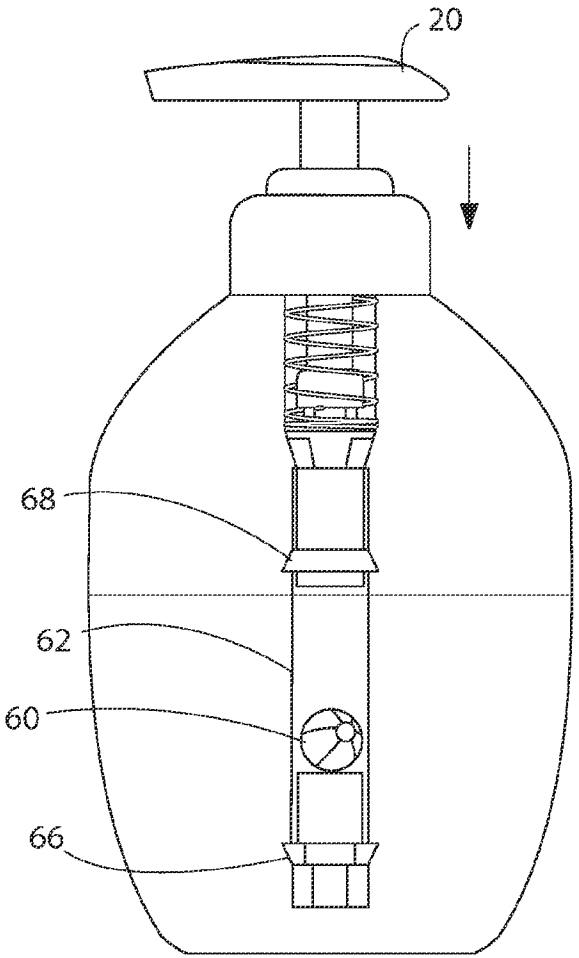
FIGS. 7 to 10 are elevation views of a dispensing container having a dip tube with a translatable element in accordance with a fourth embodiment of the invention, the Figures showing successive phases in a dispensing cycle.
Figure 7:
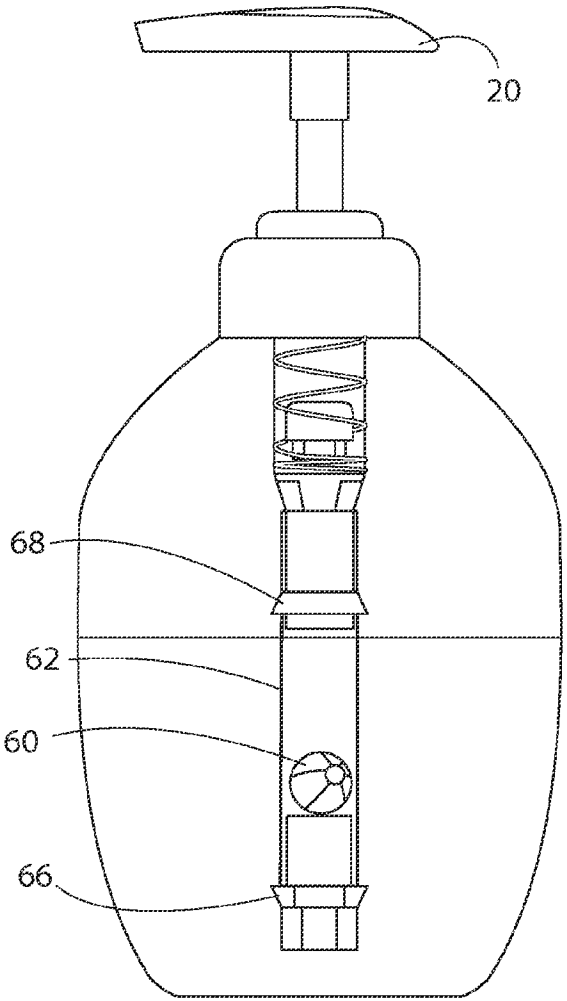
Figure 9:
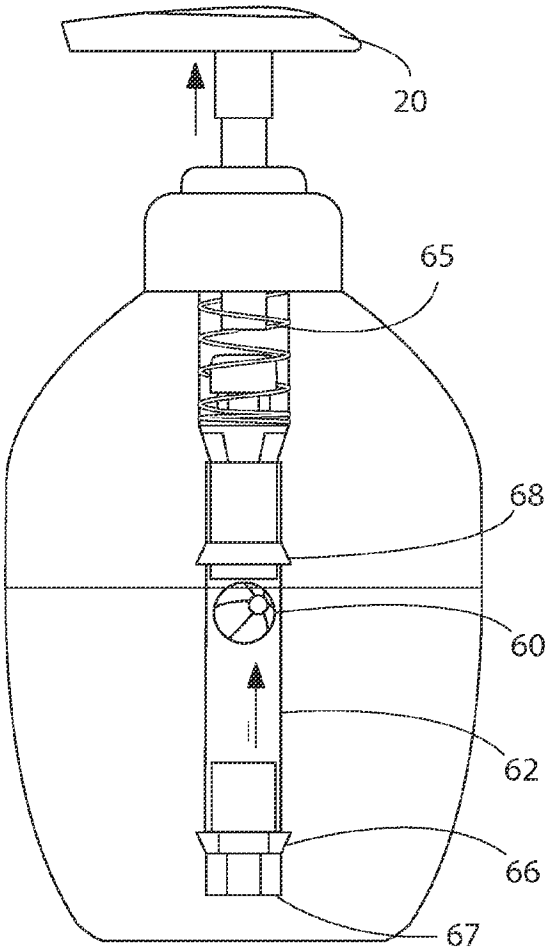

The operation to move the motion element translationally will now be described. Initially, as shown in FIG. 7, the motion element 60 rests on the lower restriction 66. During the dispensing operation, the actuator 20 is depressed manually as shown in FIG. 8, and liquid already primed into the pump mechanism 18 is dispensed through the outlet 24. After release of the actuator 20, as shown in FIG. 9, a helical spring 65 in the pump mechanism 18 urges the actuator 20 upwardly. The helical spring 65 causes the pump mechanism 18 to pump liquid upwardly into and through the dip tube 62 to replenish the pump mechanism 18 with primed liquid for the subsequent dispensing cycle. The upward liquid flow into a lowermost inlet 67 of the dip tube 62 causes the sphere 60 to be pushed upwardly by fluid flow through the dip tube 62, as shown in FIG. 9. The sphere 60 can travel as high as the upper restriction 68. As shown in FIG. 10, after the self-priming operation, the actuator 20 reaches the top of its stroke and liquid flow though the dip tube 62 terminates so that the motion element 60 subsequently falls back down due to gravity. The motion element 60 may fall as far as the lower restriction 66 at the end of the complete dispensing cycle. During the upward and downward movement, the sphere 60 can freely rotate in the dip tube 62.

Figure 12:
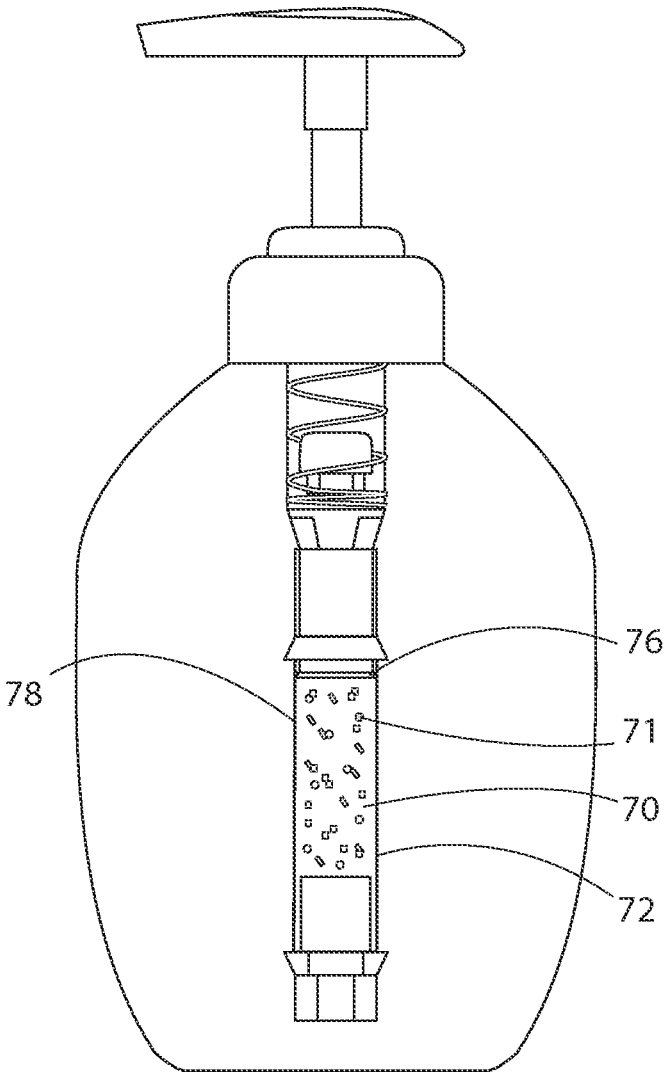
FIG. 12 is an elevation view of a dispensing container having a dip tube with a slider and a plurality of particles as a decorative element in accordance with a fifth embodiment of the invention.
Figure 13:
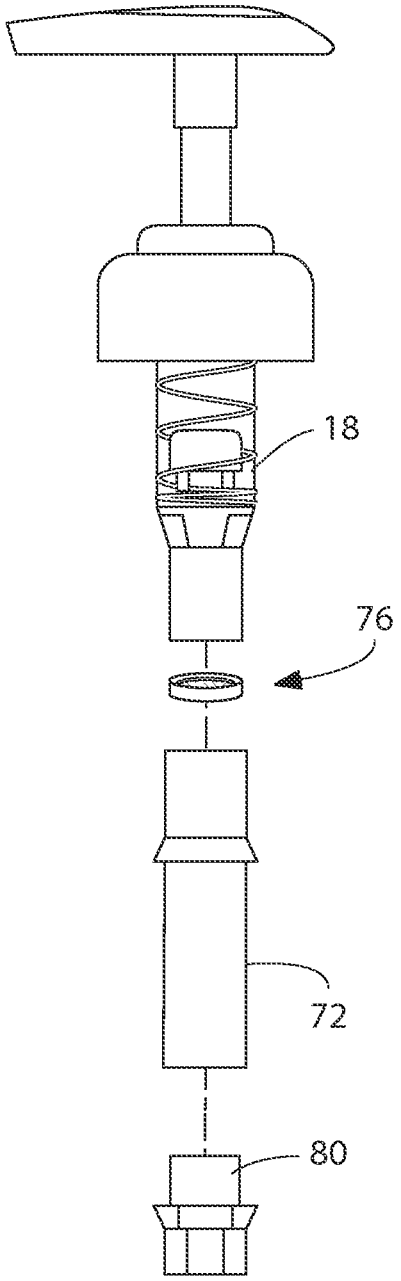
FIG. 13 is an elevation exploded view of the dispensing mechanism of the embodiment of FIG. 12.

FIGS. 12 and 13 illustrate a further embodiment in which the motion element 70 comprises a plurality of particles 71 mounted for random motion within the dip tube 72 and suspended within the liquid in the dip tube 72. The particles 71 may have one or more colors and shapes, and may be reflective, for example with a metallic surface. At least some of the plurality of particles 71 may have at least one identifiable shape, such as a geometric shape, for example a square, circle, triangle, or the shape of an object or living creature. The dip tube 72 includes an upper mesh screen 76 to prevent the plurality of particles 71 from exiting, as a result of upward liquid flow through the dip tube 72, the chamber 78 of the dip tube 72 within which the particles 71 are captured. As shown in FIG. 13, the mesh screen 76 is fitted to the lower end of the pump mechanism 18. The dip tube 72 may have the same molded shape as the dip tube of FIG. 11 and can be press-fitted onto the lower end of the pump mechanism 18 over the mesh screen 76. A lower fitting 80 can be press-fitted onto the lower end of the dip tube 72. The lower fitting 80 may or may not include a mesh screen.

In any of the embodiments of the invention, the motion element and the dip tube may be adapted to cause the motion element to move within the dip tube on pumping of the pump mechanism by a single pump stroke to cause liquid in the container to flow through the dip tube towards the pump mechanism. Therefore a single downward stroke of the pump mechanism not only dispenses liquid but also moves the motion element upwardly, or rotates the motion element, which correspondingly moves any decorative element outside the dip tube which is connected to the motion element. The dimensions of the motion element and the dip tube can be arranged so that the motion element moves a defined extent on pumping of the pump mechanism by a single pump stroke. The defined extent may indicate the dispensing of a defined amount of the liquid. In some embodiment, the movement of the motion element within the dip tube may be used as a timer, i.e., a user may determine the period of time required for the motion element to move the defined extent.

For example, if the sphere of the embodiment of FIG. 7 moves up to the top of a defined dip tube region during dispensing, this is an indication that a sufficient amount of liquid such as hand soap, has been dispensed. Alternatively, for the embodiment of FIG. 2, if the disc rotates a full rotation, this may be indicative that a sufficient amount of liquid such as hand soap, has been dispensed.

The container of the various embodiments of the invention can therefore provide an enhanced display by a dispensing container during dispensing of a liquid from the container. During use, the pump mechanism is operated to cause liquid to flow upwardly through the dip tube and out of an end of the pump mechanism and simultaneously the upward liquid flow causes motion of the motion element located or captive within the dip tube, the movement of the motion element causing a decorative effect which is visible from an exterior of the container. In addition, any liquid remaining in the dip tube that has not flow out of the pump mechanism flows downwardly back to the container due to gravity. The downward liquid flow may also causes motion of the motion element located or captive within the dip tube, the movement of the motion element causing a decorative effect which is visible from an exterior of the container.

In some embodiments the motion element is visible within the dip tube and the decorative effect is the visible movement of the motion element. In other embodiments, a decorative part is connected to the motion element and located outside the dip tube and the decorative effect is the visible movement of the decorative part.

The upward/downward liquid flow may cause rotational motion of the motion element and/or translational motion of the motion element along a portion of the dip tube. The rotational motion may be about a fixed axis, and the motion element may comprise a wheel rotated in an enlarged chamber mounted to the dip tube. The translational motion may be constrained between lower and upper extremities of the portion of the dip tube. When the motion element comprises a plurality of particles, the upward/downward liquid flow may cause random motion of the plurality of particles within the dip tube.

In any embodiment, the dip tube may be clear or colored, and may be coordinated to the liquid product and/or the label which is applied to the body portion. The dip tube can be opaque or transparent. If the dip tube is transparent, and has a similar refractive index as the surrounding liquid, the dip tube will substantially disappear in the liquid. In a preferred embodiment, the contained liquid and the dip tube material may have a refractive index of within about 0.6, and preferably within about 0.4. In this way, the dip tube may substantially disappear in the liquid. The container is at least partially or substantially transparent, as will be the product liquid that is to be dispensed. This is necessary to enable the user to readily view the motion element.

In a further embodiment the dip tube can be decorated along with the motion element to give an overall unique appearance.

The label can be shaped or partially transparent to reveal at least the motion element, for example providing a window through which the motion element may be viewed. The label may be applied by in-mold labeling or the use of a shrink film.

The container may be made of essentially any substantially transparent plastic. Glass may also be used. Useful plastics are polyvinyl chloride and polyethylene terephthalate. The dip tube may be produced from any plastic that can be extruded, and optionally blow-molded. Such polymers include homopolymers and copolymers of ethylene and propylene, vinyl compound homopolymers and copolymers, such as polyvinyl chloride, and polyesters such as polyethylene terephthalate.

Front and/or rear labels may be composed of any substantially clear plastic. The preferred plastics are thermoplastics, such as polyethylene, polypropylene including biaxially oriented polypropylene, polyvinyl chloride and polyethylene terephthalate. The front and rear labels are typically printed. In-mold labels and shrink film labels may be composed of a wide range of monolayer and laminate materials, such as thermoplastic polymers.

Other modifications to the illustrated embodiments will be apparent to those skilled in the art and are within the scope of the present invention as defined in the appended claims.

What is claimed is:

1. A container comprising a body portion and a neck portion, the neck portion having a pump dispenser thereon, the pump dispenser comprising a pump mechanism, a dip tube on one end of the pump mechanism, a pump outlet on another end of the pump mechanism, the dip tube extending from the pump mechanism into the body portion, the body portion containing a liquid, and a motion element, the motion element being located within the dip tube and adapted to be movable within the dip tube under an action of liquid flow through the dip tube, wherein the motion element and the dip tube are dimensioned to permit translational motion of the motion element along a portion of the dip tube, and a decorative element located outside the dip tube and connected to the motion element such that translation of the motion element causes translation of the decorative element, and at least a portion of the body portion being transparent, a decorative effect resulting from the motion of the motion element being visible from an exterior of the container.

2. The container according to claim 1, wherein at least a portion of the dip tube is transparent and the motion element is visible from an exterior of the container.

3. The container according to claim 2, wherein the motion element comprises a decoration.

4. The container according to claim 1, wherein the decorative element is a disc having at least one image.

5. The container according to claim 4, wherein the disc has a plurality of circumferentially arranged images.

6. The container according to claim 1, wherein the dip tube includes an enlarged chamber within which the motion element is disposed.

7. The container according to claim 6, wherein the enlarged chamber is cylindrical.

8. The container according to claim 1, wherein the decorative element comprises a shape representative of a living creature.

9. The container according to claim 1, wherein the dip tube includes lower and upper restrictions defining lower and upper extremities of the portion of the dip tube along which the motion element can move translationally.

10. The container according to claim 1, wherein the motion element is a sphere.

11. The container according to claim 10, wherein the sphere is externally patterned to resemble a sports ball.

12. The container according to claim 1, wherein the motion element and the dip tube are adapted to cause the motion element to move within the dip tube on pumping of the pump mechanism by a single pump stroke to cause liquid in the container to flow through the dip tube towards the pump mechanism.

13. The container according to claim 1, wherein the motion element and the dip tube are adapted to permit the motion element to move a defined extent on pumping of the pump mechanism by a single pump stroke.

14. The container according to claim 13, wherein the defined extent indicates the dispensing of a defined amount of the liquid.

15. A method of providing an enhanced display by a dispensing container during dispensing of a liquid from the container, the method comprising the steps of:

a. providing a dispensing container including a pump mechanism and a dip tube extending from the pump mechanism into liquid to be dispensed from the container;

b. operating the pump mechanism to cause liquid to flow through the dip tube and out of an end of the pump mechanism; and c. the liquid flow causing translational motion of a motion element within a portion of the dip tube, the movement of the motion element causing a decorative effect which is visible from an exterior of the container;

wherein a decorative part is connected to the motion element and located outside the dip tube and the decorative effect is the visible movement of the decorative part.

16. The method according to claim 15, wherein the motion element is visible within the dip tube and the decorative effect includes the visible movement of the motion element.

17. The method according to claim 15, wherein the translational motion is constrained between lower and upper extremities of the portion of the dip tube.

18. The method according to claim 15, wherein the motion element moves within the dip tube on pumping of the pump mechanism by a single pump stroke to cause liquid in the container to flow through the dip tube towards the pump mechanism.

19. The method according to claim 18, wherein the motion element moves a defined extent on pumping of the pump mechanism by a single pump stroke.

20. The method according to claim 19, wherein the defined extent indicates the dispensing of a defined amount of the liquid.

* * * * *